US008322885B2

(12) United States Patent
Chen et al.

(10) Patent No.: US 8,322,885 B2
(45) Date of Patent: Dec. 4, 2012

(54) LAMP

(75) Inventors: Chih-Ming Chen, Hualien County (TW); Cheng-Hung Yang, Miaoli County (TW)

(73) Assignee: Lextar Electronics Corporation, Hsinchu (TW)

( * ) Notice: Subject to any disclaimer, the term of this patent is extended or adjusted under 35 U.S.C. 154(b) by 661 days.

(21) Appl. No.: 12/549,350

(22) Filed: Aug. 27, 2009

(65) Prior Publication Data

US 2010/0284188 A1 Nov. 11, 2010

(30) Foreign Application Priority Data

May 5, 2009 (TW) ..... 98114876 A

(51) Int. Cl.
*F21V 21/00* (2006.01)

(52) U.S. Cl. ..... 362/249.06; 362/249.02; 362/249.03; 362/545; 362/800; 313/500

(58) Field of Classification Search ..... 362/97.3, 362/249.02–249.06, 545, 612, 800; 313/500
See application file for complete search history.

(56) References Cited

U.S. PATENT DOCUMENTS

| | | | | |
|---|---|---|---|---|
| 6,626,557 | B1 * | 9/2003 | Taylor | 362/249.06 |
| 7,387,403 | B2 * | 6/2008 | Mighetto | 362/800 |
| 7,972,036 | B1 * | 7/2011 | Schach et al. | 362/249.06 |

FOREIGN PATENT DOCUMENTS

| | | |
|---|---|---|
| TW | M325435 | 1/2008 |
| TW | M334252 | 6/2008 |
| TW | M338314 | 8/2008 |

* cited by examiner

*Primary Examiner* — Stephen F Husar

(57) ABSTRACT

A lamp including a carrier and a plurality of light source modules stacked to the carrier is provided. Each light source module includes a circuit board and a plurality of light-emitting diodes, wherein the light-emitting diodes are disposed on at least one side of the circuit board and electrically connected to the circuit board.

31 Claims, 8 Drawing Sheets

LAMP

CROSS-REFERENCE TO RELATED APPLICATION

This application claims the priority benefit of Taiwan application serial no. 98114876, filed on May 5, 2009. The entirety of the above-mentioned patent application is hereby incorporated by reference herein and made a part of specification.

BACKGROUND OF THE INVENTION

1. Field of the Invention

The present invention relates to a lamp, and more particularly to a lamp adopting light-emitting diodes as light-emitting devices.

2. Description of Related Art

With the progress in semiconductor technology, the power attained by a light-emitting diode (LED) becomes increasingly larger, and the intensity of the light emitted is getting even higher. Further, due to its advantages in being power saving, environment-friendly, and durable with a rapid response and a small volume, the LED is widely applied in products such as illuminating apparatus, traffic signals, displays, and optical mice, and is on its way to replace the conventional fluorescent lamp.

FIG. 1 is an LED lamp disclosed in TW Patent No. M338314. Referring to FIG. 1, one end of a base 10 of the LED lamp is disposed with a corresponding joint 11 and the other end is combined with a bottom substrate 12. Here, the bottom substrate 12 is disposed with a plurality of LEDs 20. At least three vertical substrates 30 are combined on the bottom substrate 12, and outer side surfaces of the three vertical substrates 30 are combined with the LEDs 20. Moreover, the LEDs 20 are forward LEDs.

A disadvantage of a conventional LED lamp is that the forward LED has a greater volume, thus limiting a design of the LED lamp. In other words, the LED lamp adopting the forward LEDs does not usually have a variation of configurations. In addition, a light-radiation of this LED lamp is hard to control.

In TW Patent Publication No. 200810143, a replaceable LED module capable of replacing damaged light-emitting modules is disclosed. However, the replaceable LED module also adopts the forward LEDs, thus including the disadvantages aforementioned. Hence, it is still necessary to obtain a lamp capable of both adjusting the light-radiation and replacing the LEDs.

SUMMARY OF THE INVENTION

A lamp capable of stacking a plurality of light source modules to a carrier is provided in the present invention.

A lamp including a carrier and a plurality of light source modules stacked to the carrier is provided in the present invention. Each light source module includes a circuit board and a plurality of light-emitting diodes (LEDs). The LEDs are disposed on at least one side of the circuit board and far away from the carrier. The LEDs are electrically connected to the circuit board.

In one embodiment of the present invention, the carrier includes a pillar and a base. The pillar is disposed on the base and the light source modules are stacked to the pillar.

In one embodiment of the present invention, the circuit board has a through hole and the pillar passes through the through hole so as to retain (distinguish a polarity) the circuit board on the pillar.

In one embodiment of the present invention, the LEDs surround the pillar.

In one embodiment of the present invention, each light source module has a plurality of protrusions disposed on one side of the circuit board. The LEDs surround the through hole and the protrusions are disposed between the LEDs and the through hole.

In one embodiment of the present invention, the through hole is circular, elliptical, or polygonal in shape.

In one embodiment of the present invention, an outer contour of the circuit board is circular, elliptical, or polygonal in shape.

In one embodiment of the present invention, the LEDs are surface mount device (SMD) LEDs.

In one embodiment of the present invention, each LED includes a side view LED. The side view LED has a light-emitting side facing outward of each circuit board.

In one embodiment of the present invention, the carrier has a set of first electrodes and is electrically connected to the circuit board via the set of first electrodes.

In one embodiment of the present invention, each LED has a set of second electrodes and is electrically connected to the circuit board via the set of second electrodes. In one embodiment of the present invention, a power required by the LEDs is provided by the pillar. In another embodiment of the present invention, each light source module has a set of third electrodes and is electrically connected to the circuit board via the set of third electrodes. In another embodiment of the present invention, the pair of third electrodes is a pair of conductive protrusions.

In one embodiment of the present invention, the lamp further includes an optical lens disposed on optical paths of lights emitted by the LEDs.

In one embodiment of the present invention, the lamp further includes a connector disposed on the carrier and electrically connected the circuit board.

In one embodiment of the present invention, the connector has a pair of electrode rods protruding away from the carrier from a surface of the connector.

In one embodiment of the present invention, the pair of electrode rods is in a shape of a cylinder, a quadrangular prism, or a pillar of other forms.

In light of the foregoing, the lamp of the present invention stacks a plurality of light source modules to the carrier. When one of the light source modules is damaged and needs replacement, only the damaged light source module is replaced. Moreover, the lamp of the present invention adopts the side view LEDs to enhance a light utilization rate.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
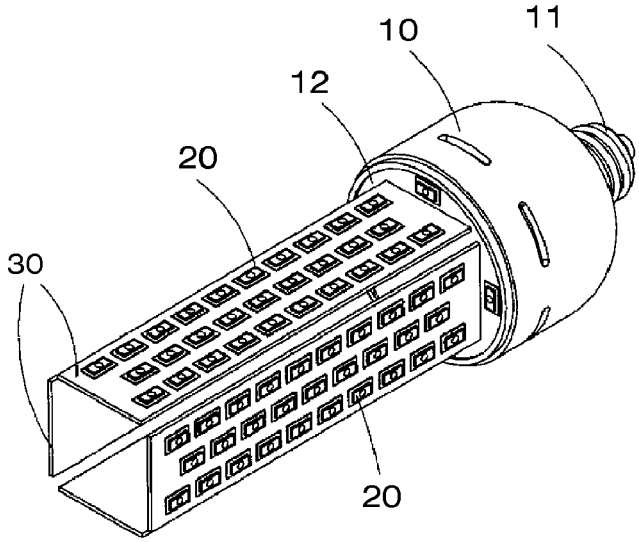
FIG. 1 ( PRIOR ART )
FIG. 1 is an LED lamp disclosed in TW Patent No. M338314.
Figure 2:
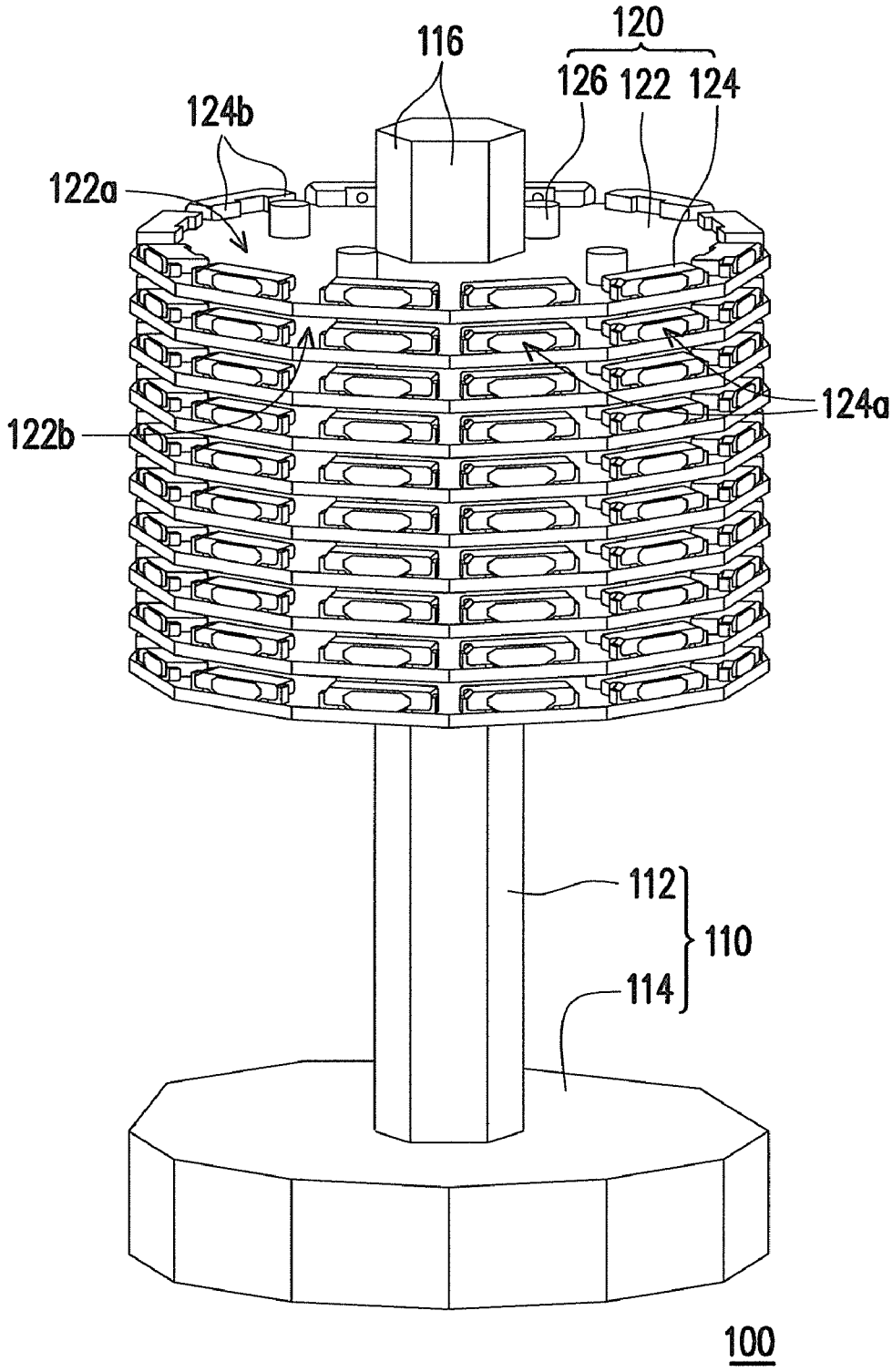
FIG. 2 is a schematic view of a lamp according to an embodiment of the present invention.

FIG. 2 is a schematic view of a lamp according to an embodiment of the present invention. Referring to FIG. 2, a lamp 100 includes a carrier 110 and a plurality of light source modules 120. Moreover, the light source modules 120 are stacked onto and assembled with the carrier 110. Each light source module 120 includes a circuit board 122 and a plurality of light-emitting diodes (LEDs) 124. The LEDs 124 are disposed on an upper side 122*a* or/and a lower side 122*b* of the circuit board 122 and away from the carrier 110. Furthermore, the LEDs 124 are electrically connected to the circuit board 122.

In the present embodiment, the carrier 110 includes a pillar 112 and a base 114. The pillar 112 is disposed on the base 114 and the LEDs 124 surround the pillar 112. The light source modules 120 are stacked to the pillar 112. Compared to a conventional LED lamp, in the lamp 100 of the present embodiment the light source modules 120 are stacked to the pillar 112. Moreover, each of the light source modules 120 is independently disposed. Therefore, if one of the light source modules 120 is damaged and requires replacement, only the damaged light source module 120 is needed to be replaced. Hence, not only is the lamp 100 repaired rapidly, but a cost of repairing the lamp 100 is reduced effectively.

For example, when the LEDs 124 disposed on the light source module 120 which is three layers down from the top of the pillar 112 are damaged, maintenance staffs can remove the first and the second layers of light source modules 120 upwardly from the pillar 112 and replace the damaged third layer of light source module 120. Thereafter, the maintenance staffs stack the original first and second layers of light source modules 120 from the top of the pillar 112 downwardly thereinto. Thus, the lamp 100 of the present embodiment is time and labor saving in maintenance.

Figure 3:
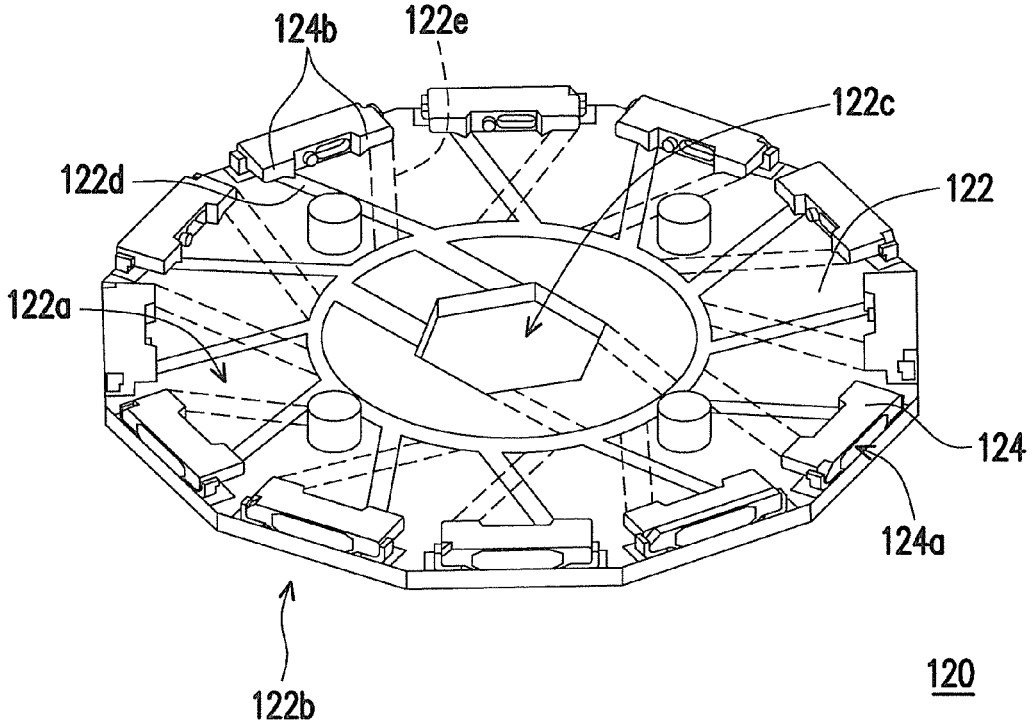
FIG. 3 is a schematic view of a light source module in FIG. 2.

FIG. 3 is a schematic view of the light source module in FIG. 2. Referring to FIG. 2 and FIG. 3, in the present embodiment, the LEDs 124 are surface mount device (SMD) LEDs, for example. As a result, the LEDs 124 can combine a surface mount technology (SMT) with the circuit board 122 so as to enhance a manufacturing efficiency of the light source module 120.

In addition, the LEDs 124 can be side view LEDs each having a light-emitting side 124*a* which faces outward of the circuit board 122. Consequently, most of the lights emitted by the LEDs 124 are parallel to the circuit board 122 and directly emitted outside of the circuit board 122 to enhance a light utilization rate. Additionally, the present invention does not limit a number of the LEDs 124. In other words, the number of LEDs 124 disposed on each light source module 120 is the same or different depending on the actual situation to correspond to different design demands. Besides, by obtaining LEDs 124 of many different colors, the light source module 120 is capable of providing different color combinations so as to increase the flexibility in use of the lamp 100.

In the present embodiment, the circuit board 122 has a through hole 122*c* and the pillar 112 passes through the through hole 122*c* for retaining the circuit board 122 on the pillar 112. Moreover, in the present embodiment, an outer contour of the circuit board 122 is a dodecagon, for example, and the through hole 122*c* is a hexagon, for example.

In other embodiments, the outer contour of the circuit board 122 and the shape of the through hole 122*c* also have circular, elliptical, or other polygonal shapes. Under possible situations, technicians in the field can alter the size, the shape, and the number of the circuit board 122 and also modify the size, the shape, the location, or the mode of the through hole 122*c* to fulfill actual requirements.

For example, areas of the circuit boards 122 can increase along a direction towards the base 114 and form a configuration similar to a shape of a Christmas tree. On the other hand, the areas of the circuit boards 122 do not increase or decrease along the direction towards the base 114, so that different overall light-radiations are produced. Hence, the lamp 100 of the present embodiment is capable of having more variation in configurations thereof by disposing the circuit boards 122 of different areas.

In addition, the carrier 110 includes a set of first electrodes 116 and is electrically connected to the circuit board 122 via the set of first electrodes 116. Similarly, each LED 124 includes a set of second electrodes 124*b* and is electrically connected to the circuit board 122 via the set of second electrodes 124*b*.

More specifically, the first electrodes 116 are disposed on a side wall of the pillar 112. As the pillar 112 passes through the through hole 122*c* of the circuit board 122 to be directly contacted with the circuit board 122, the first electrodes 116 are electrically connected to the circuit board 122 as a result. Additionally, the second electrodes 124*b* are electrically connected to the circuit board 122 through conductive lines 122*d* which are disposed on the circuit board 122 and conductive lines 122*e* (illustrated with dotted line) which are disposed on an internal layer of the circuit board 122. At this time, the power required by the LEDs 124 is provided directly by the pillar 112.

Figure 4:
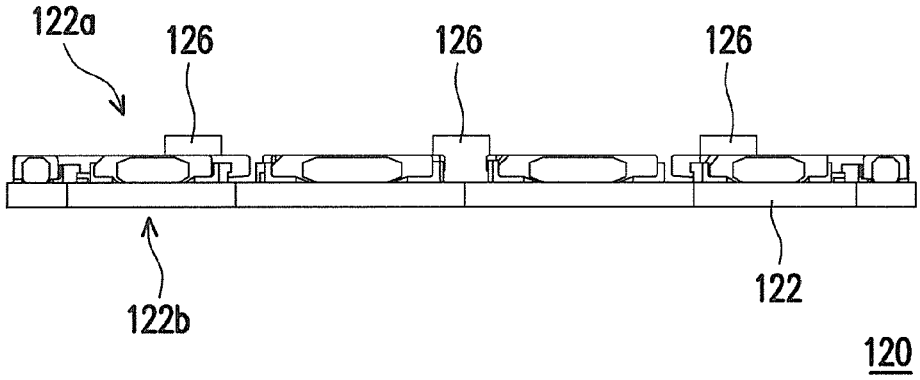
FIG. 4 is a side view of the light source module in FIG. 2.

FIG. 4 is a side view of the light source module in FIG. 2. Referring to FIG. 2, FIG. 3, and FIG. 4, in the present embodiment, the light source module 120 has four protrusions 126 disposed on one side 122*a* of the circuit board 122 (only three protrusions 126 are illustrated in FIG. 4). The LEDs 124 surround the through hole 122*c* and the protrusions 126 are disposed between the LEDs 124 and the through hole 122*c*. It should be noted that a height of the protrusions 126 is higher than a height of the LEDs 124.

Consequently, each circuit board 122 is capable of maintaining a certain distance from other adjacent circuit boards 122 by the protrusions 126. As a result, the LEDs 124 on the circuit board 122 are prevented from being damaged by collisions when the circuit boards 122 are stacked to the pillar 112. Obviously, in other embodiments, the light source module 120 merely has one or other numbers of protrusion(s) 126, and the present invention does not limit the number of protrusions 126. Moreover, the protrusions 126 are all disposed on the other side 122*b* of the circuit board 122 or simultaneously disposed on the two sides 122*a* and 122*b* of the circuit board 122.

Figure 5:
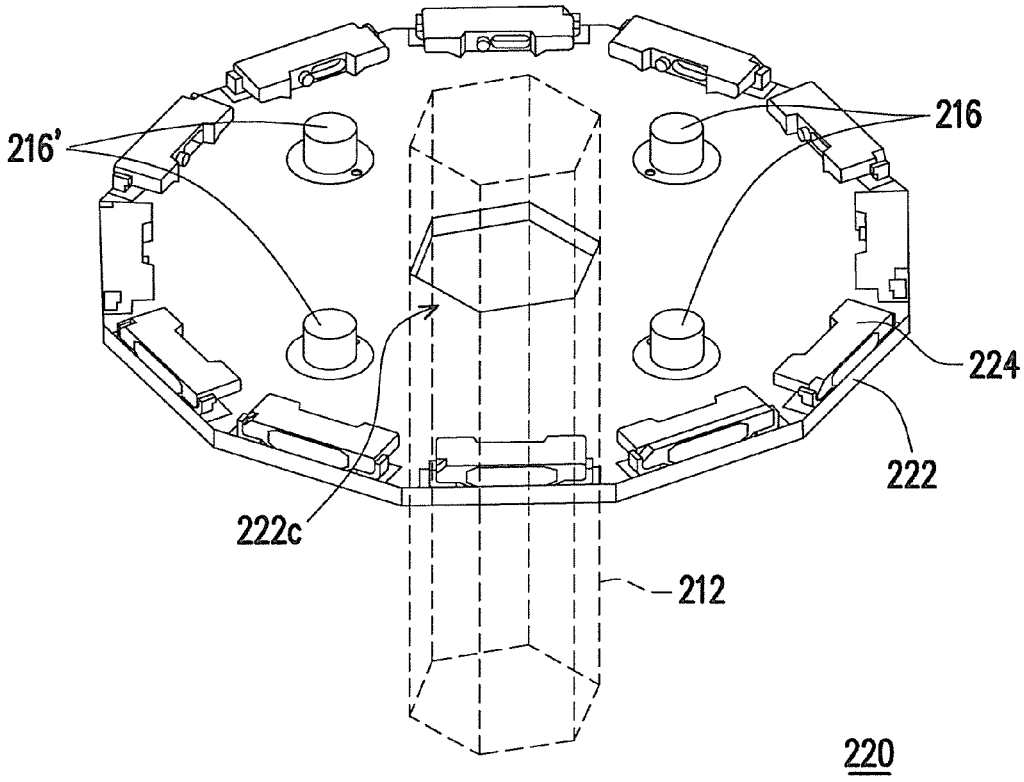
FIG. 5 is a schematic view of a light source module of a lamp according to another embodiment of the present invention.
Figure 6:
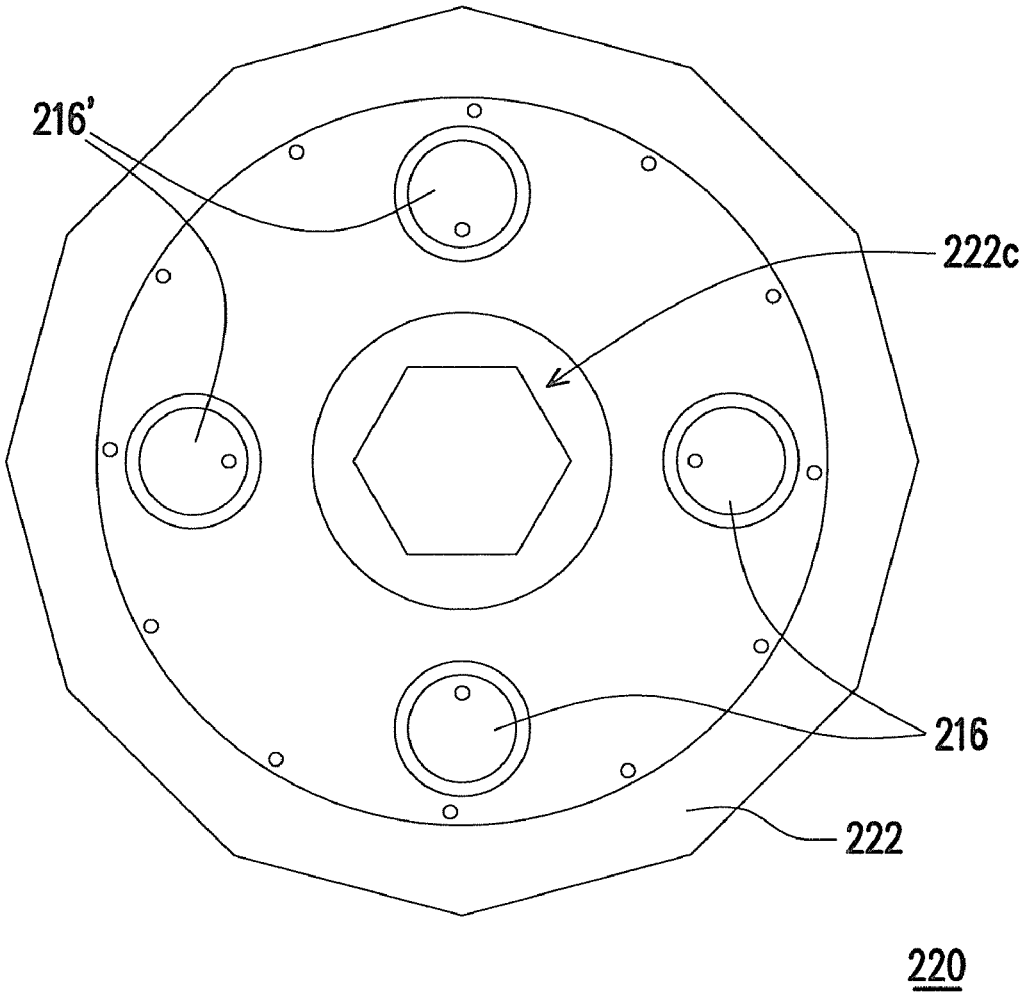
FIG. 6 is a bottom view of the light source module in FIG. 5.

FIG. 5 is a schematic view of a light source module of a lamp according to another embodiment of the present invention. FIG. 6 is a bottom view of the light source module in FIG. 5. Referring to FIG. 5 and FIG. 6, a difference between a light source module 220 of the present embodiment and the light source module 120 of the aforementioned embodiment is that in the present embodiment, the light source module 220 has two sets of third electrodes 216 and 216', and the light source module 220 is electrically connected to a circuit board 222 via the third electrodes 216 and the third electrodes 216'. However, in other embodiment, the light source module 220 is also electrically connected to the circuit board 222 via a set of third electrodes 216. Here, the other set of third electrodes 216' provides a function of serially connecting the adjacent circuit boards 222.

In the present embodiment, the two sets of third electrodes 216 and 216' are conductive protrusions, for instance. LEDs 224 surround a through hole 222*c* and the conductive protrusions are disposed between the LEDs 224 and the through hole 222*c*. At this time, the power required by the LEDs 224 is provided externally and a pillar 212 provides a function of fixing the circuit board 222. It should be noted that a height of the conductive protrusions is higher than a height of the LEDs 224.

Hence, each circuit board 222 is conductive through the third electrodes 216, 216' and capable of maintaining a certain distance from other adjacent circuit boards 222. Therefore, when the circuit boards 222 are stacked to the pillar 212, the LEDs 224 on the circuit boards 222 are prevented from damages caused by collisions.

Figure 7:
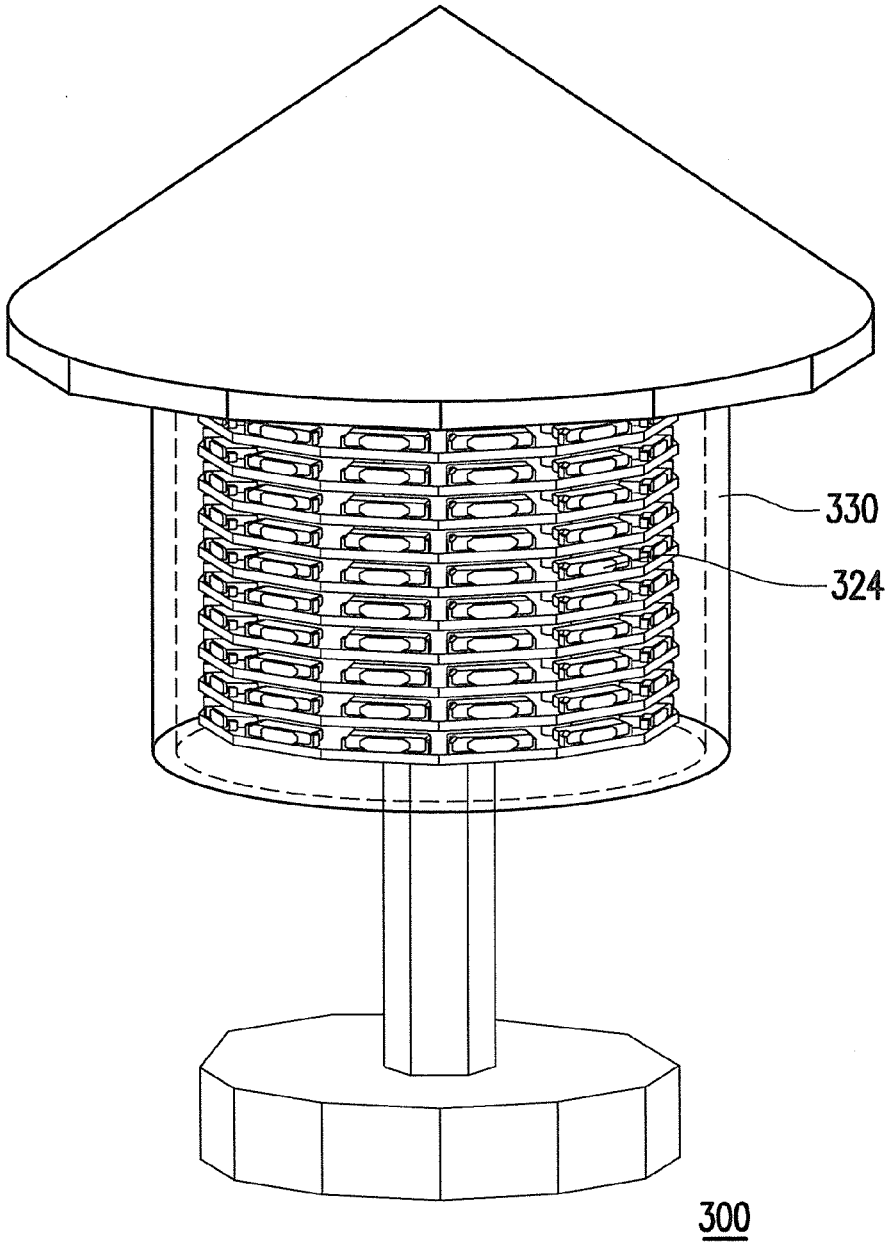
FIG. 7 is a schematic view of a lamp according to another embodiment of the present invention.

FIG. 7 is a schematic view of a lamp according to another embodiment of the present invention. Referring to FIG. 7, in the present invention, a lamp 300 further includes an optical lens 330. The optical lens 330 is disposed on optical paths of lights emitted by LEDs 324 for increasing a light-emitting brightness and adjusting a light-emitting angle of the LEDs 324. Moreover, a material of the optical lens 330 includes highly transparent thermoplastic resins or glass.

Figure 8:
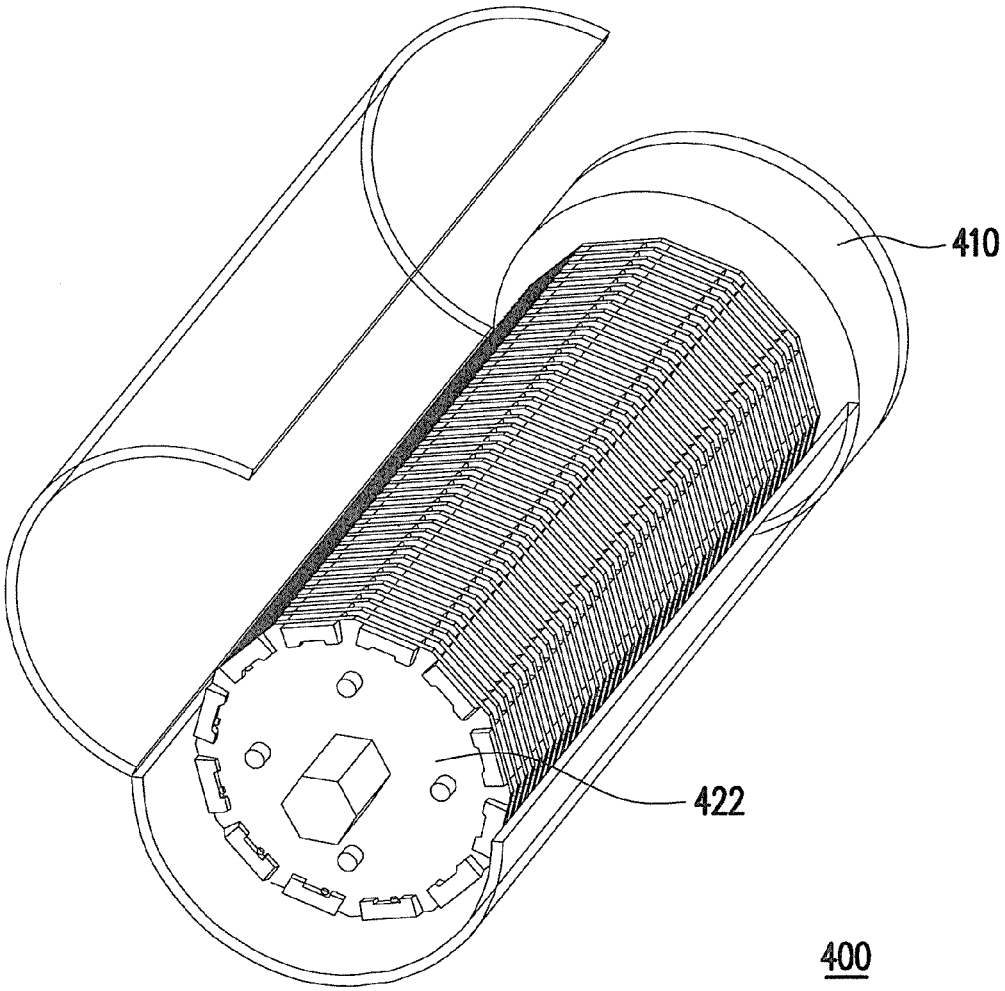
FIG. 8 is a schematic view of a lamp according to another embodiment of the present invention.
Figure 9:
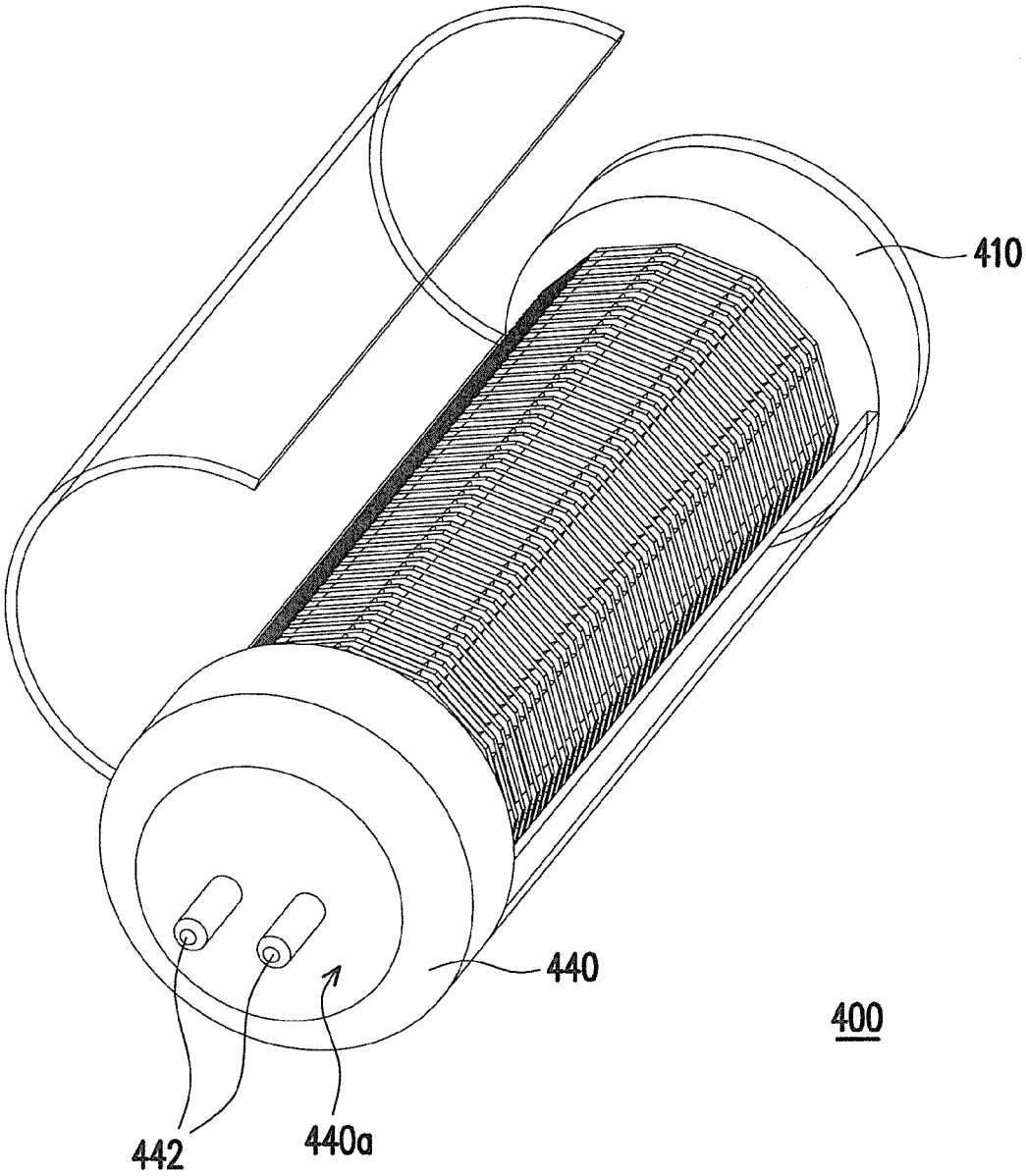
FIG. 9 is a schematic view of a combination of the lamp and a socket in FIG. 8.

FIG. 8 is a schematic view of a lamp according to another embodiment of the present invention. FIG. 9 is a schematic view of the lamp of FIG. 8 after assembly. Referring to FIG. 8 and FIG. 9, in the present embodiment, a lamp 400 further includes a connector 440. The connector 440 is disposed on a carrier 410 and electrically connected to a circuit board 422. In addition, the connector 440 has a pair of electrode rods 442. The pair of electrode rods 442 protrudes away from the carrier 410 from a surface 440*a* of the connector 440 for plugging into a socket of a lamp holder (not shown) so as to be electrically connected with the lamp holder.

It should be noted that the electrode rods 442 are designed as electrode rods 442 satisfying specifications of the lamp holder to fulfill actual demands. Furthermore, in the present embodiment, the electrode rods 442 are in a shape of a cylinder. However, in other embodiments, the electrode rods are also in a shape of a quadrangular prism or a pillar of other forms.

In summary, the lamp of the present invention stacks the light source modules to the carrier. When one of the light source modules is damaged and needs replacement, only the damaged light source module has to be replaced. Moreover, the lamp of the present invention adopts the side view LEDs, where most of the lights emitted therefrom are parallel to the circuit boards and directly emitted outside of the circuit boards for enhancing the light utilization rate. In addition, the LEDs have different colors for providing different color combinations, thereby enhancing the flexibility in use of the lamp. Besides, the lamp is capable of having more variation in the configurations thereof by disposing the circuit boards of different areas. The lamp also includes the optical lens for increasing the light-emitting brightness and adjusting the light-emitting angle of the LEDs.

Although the present invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A lamp, comprising:

a carrier; and a plurality of light source modules stacked to the carrier, and each of the light source modules comprising:

a circuit board; and a plurality of light-emitting diodes (LEDs), disposed on at least one side of the circuit board and electrically connected to the circuit board, wherein the carrier comprises a pillar and a base, and the pillar is disposed on the base whereas the plurality of light source modules are stacked to the pillar, wherein a power required by the plurality of LEDs is provided by the pillar.

2. The lamp as claimed in 1, wherein the circuit board has a through hole and the pillar passes through the through hole so as to retain the circuit board on the pillar.

3. The lamp as claimed in claim 1, wherein the plurality of LEDs surround the pillar.

4. The lamp as claimed in claim 2, wherein each of the light source modules has a plurality of protrusions disposed on one side of the circuit board, and the plurality of LEDs surrounds the through hole while the plurality of protrusions is disposed between the plurality of LEDs and the through hole.

5. The lamp as claimed in claim 2, wherein the through hole is circular, elliptical, or polygonal in shape.

6. The lamp as claimed in claim 1, wherein an outer contour of the circuit board is circular, elliptical, or polygonal in shape.

7. The lamp as claimed in claim 1, wherein the plurality of LEDs is surface mount device (SMD) LEDs.

8. The lamp as claimed in claim 1, wherein each of the LEDs comprises a side view LED having a light-emitting side facing outward of each circuit board.

9. The lamp as claimed in claim 1, wherein the carrier has a set of first electrodes and is electrically connected to the circuit board via the set of first electrodes.

10. The lamp as claimed in claim 1, wherein each of the LEDs comprises a set of second electrodes and is electrically connected to the circuit board via the set of second electrodes.

11. The lamp as claimed in claim 1, wherein each of the light source modules comprises a set of third electrodes and is electrically connected to the circuit board via the set of third electrodes.

12. The lamp as claimed in claim 11, wherein the set of third electrodes is a pair of conductive protrusions.

13. The lamp as claimed in claim 1, further comprising an optical lens disposed on optical paths of lights emitted by the plurality of LEDs.

14. The lamp as claimed in claim 1, further comprising a connector disposed on the carrier and electrically connected to the circuit board.

15. The lamp as claimed in claim 14, wherein the connector has a pair of electrode rods protruding away from the carrier from a surface of the connector.

16. The lamp as claimed in claim 15, wherein the pair of electrode rods is in a shape of a cylinder, a quadrangular prism, or a pillar of other forms.

17. A lamp, comprising:

a carrier; and a plurality of light source modules stacked to the carrier, and each of the light source modules comprising:

a circuit board; and a plurality of light-emitting diodes (LEDs), disposed on at least one side of the circuit board and electrically connected to the circuit board, wherein the carrier comprises a pillar and a base, and the pillar is disposed on the base whereas the plurality of light source modules are stacked to the pillar, wherein the circuit board has a through hole and the pillar passes through the through hole so as to retain the circuit board on the pillar, wherein each of the light source modules has a plurality of protrusions disposed on one side of the circuit board, and the plurality of LEDs surrounds the through hole while the plurality of protrusions is disposed between the plurality of LEDs and the through hole.

18. The lamp as claimed in claim 17, wherein the plurality of LEDs surround the pillar.

19. The lamp as claimed in claim 17, wherein the through hole is circular, elliptical, or polygonal in shape.

20. The lamp as claimed in claim 17, wherein an outer contour of the circuit board is circular, elliptical, or polygonal in shape.

21. The lamp as claimed in claim 17, wherein the plurality of LEDs is surface mount device (SMD) LEDs.

22. The lamp as claimed in claim 17, wherein each of the LEDs comprises a side view LED having a light-emitting side facing outward of each circuit board.

23. The lamp as claimed in claim 17, wherein the carrier has a set of first electrodes and is electrically connected to the circuit board via the set of first electrodes.

24. The lamp as claimed in claim 17, wherein each of the LEDs comprises a set of second electrodes and is electrically connected to the circuit board via the set of second electrodes.

25. The lamp as claimed in claim 17, wherein a power required by the plurality of LEDs is provided by the pillar.

26. The lamp as claimed in claim 17, wherein each of the light source modules comprises a set of third electrodes and is electrically connected to the circuit board via the set of third electrodes.

27. The lamp as claimed in claim 26, wherein the set of third electrodes is a pair of conductive protrusions.

28. The lamp as claimed in claim 17, further comprising an optical lens disposed on optical paths of lights emitted by the plurality of LEDs.

29. The lamp as claimed in claim 17, further comprising a connector disposed on the carrier and electrically connected to the circuit board.

30. The lamp as claimed in claim 29, wherein the connector has a pair of electrode rods protruding away from the carrier from a surface of the connector.

31. The lamp as claimed in claim 30, wherein the pair of electrode rods is in a shape of a cylinder, a quadrangular prism, or a pillar of other forms.

* * * * *